US010688365B2

(12) United States Patent
Bidlack

(10) Patent No.: US 10,688,365 B2
(45) Date of Patent: Jun. 23, 2020

(54) SPORT (GOLF) HANDS

(71) Applicant: Lane Bidlack, Perrysburg, OH (US)

(72) Inventor: Lane Bidlack, Perrysburg, OH (US)

( * ) Notice: Subject to any disclaimer, the term of this patent is extended or adjusted under 35 U.S.C. 154(b) by 0 days.

(21) Appl. No.: 16/244,472

(22) Filed: Jan. 10, 2019

(65) Prior Publication Data

US 2019/0217179 A1 Jul. 18, 2019

Related U.S. Application Data

(60) Provisional application No. 62/616,480, filed on Jan. 12, 2018.

(51) Int. Cl.
*A63B 69/36* (2006.01)
*A63B 71/14* (2006.01)
*A63B 1/00* (2006.01)

(52) U.S. Cl.
CPC ..... *A63B 69/3632* (2013.01); *A63B 1/00* (2013.01); *A63B 71/146* (2013.01)

(58) Field of Classification Search
CPC ..... A63B 69/3632; A63B 71/146
See application file for complete search history.

(56) References Cited

U.S. PATENT DOCUMENTS 5,004,231 A * 4/1991 Alread ..... A63B 21/4019 2/159
2004/0214650 A1* 10/2004 Ryan ..... A63B 69/3632 473/226
2005/0268372 A1* 12/2005 DeMarco ..... A41D 19/01552 2/160

* cited by examiner

*Primary Examiner* — Jeffrey S Vanderveen
(74) *Attorney, Agent, or Firm* — Schaffer, Schaub & Marriott, Ltd.

(57) ABSTRACT

This device is for assisting a person having insufficient control of one or more hands to strengthen and improve coordination of the hand and use a sporting element for effectively striking a ball. The device comprises: a body having an elongated open-end tube funnel having a hollow interior portion adapted to be secured to a shaft of the sporting element. The device also includes a second body having two spaced apart opposing side walls; wherein the body portion is substantially C-shaped. The bodies are attached to a pair of "golf hands" gloves.

16 Claims, 7 Drawing Sheets

SPORT (GOLF) HANDS

CROSS REFERENCE TO RELATED APPLICATION

The present patent application claims the benefit of U.S. Provisional Patent Application 62/616,480 filed Jan. 12, 2018. All subject matter contained in the application is expressly incorporated herein.

FIELD OF THE INVENTION

This invention relates a device for use on a sporting device such as a golf club. More particularly, the device aids in the gripping of the sporting device. The device actually becomes the hands of the user.

BACKGROUND OF INVENTOR

This is a sport-related invention; mainly for golf but not limited to that sport. Basically, any racket sport or stick sport where the participant is unable to hold their playing implement. I am a personal trainer with a bachelor's degree in Kinesiology and I have created the invention for the assistance of those afflicted with either arthritis, very limited use of their hands, or are without hands or limbs at all. I work for a country club presently and came up with the concept while working with members who have severe arthritis yet still attempt to play golf. My background in Biomechanics was also instrumental for this concept in a way to still hold on to a stick or shaft and complete a swing; which would have previously been hindered or limited by little to no grip.

BACKGROUND OF THE INVENTION

The golf industry alone is a billion-dollar industry having millions of enthusiasts. Some people, however, have physical disabilities which prevent them from enjoying sports such as golf. Many people suffer from afflictions such as debilitating or degenerative muscle/tissue diseases, and neurological injuries. Diseases and injuries can limit an individual's muscular and neurological function. For example, a stroke can lead to extremities that are weak or unable to function properly. Persons suffering from the muscular and neurological effects of these conditions are often unable to participate in sporting activities. Thus, a need exists for a device to help those people with muscular or neurological limitations to be able to participate in sporting activities.

SUMMARY OF THE INVENTION

This invention is intended to aid in those still wishing to continue their sport which requires them to clasp or hold a racket, golf club, paddle, handle, wheel; whatever they are in need of gripping but are physically incapable of or are limited to do because of severe immobility in their hands or wrists, or lack a hand or forearm(s) due to some unfortunate circumstance. The invention allows them to clasp and hold, with the continued range of motion required of their sport, their sport's implement, and allows them to continue on with their sport without having to give that sport up entirely. In the preferred embodiment, the invention is intended for sport use specifically. The device, in a preferred embodiment of golf hands, is a pair of gloves that are designed mechanically to attach to the user's golf club, holding the club so the user does not have to, while putting the user's hands in the right position for the proper swing. Golf hands actually becomes the user's hands.

The device of this invention is for assisting a person having insufficient control of one or more hands to strengthen and improve coordination of the hand and use a sporting element for effectively striking a ball. The device comprises: a one-piece body portion having an elongated open-end tube funnel having a hollow interior portion adapted to be secured to a shaft of the sporting element, the body portion having two spaced apart opposing side walls; wherein the body portion is substantially C-shaped; and a plurality of V-shaped, elongated extensions extending from the one-piece body portion to aid the hands to hold the shaft of the sporting element.

BRIEF DESCRIPTION OF THE DRAWINGS

The drawings show the device of this invention in a preferred embodiment of golf hands. Golf hands is a pair of gloves that are designed mechanically to attach to the golf club, holding the club so the user does not have to while putting the user's hands in the right position for the proper swing. Golf hands actually becomes the user's hands.

DETAILED DESCRIPTION OF THE INVENTION

FIGS. 1-7 illustrate the following. The Figs. Show a device for assisting a person having insufficient control of one or more hands to strengthen and improve coordination of the hand and use a sporting element for effectively striking a ball. The device comprises: a one-piece body portion having an elongated open-end tube funnel having a hollow interior portion adapted to be secured to a shaft of the sporting element, the body portion having two spaced apart opposing side walls; wherein the body portion is substantially C-shaped; and a plurality of V-shaped, elongated extensions extending from the one-piece body portion to aid the hands to hold the shaft of the sporting element. The device further comprises a means to secure the one-piece body portion to the shaft of the sporting element. In the preferred embodiment, the means to secure is a C-shaped clamp or strap.

Golf hands is a pair of gloves that are designed mechanically to attach to a golf club, holding the club so the user does not have to while putting the user's hands in the right position for the proper swing. Golf hands actually becomes the user's hands. The preferred clasp system allows the user to connect and disconnect from any golf club with ease. Once the user is locked into place with the club, the user can completely let go and still perform a full and perfect swing without having to worry about the club leaving the user's hands. In order to use golf hands, first the user must put on both gloves and make sure the gloves are on securely. Then attach the upper bracket by opening the lever to loosen the cinch strap, slipping it over the top of the handle. Then close the lever to tighten it down, making sure to have the angle of the club head set where you want it and then lock the club in place. Next, place the other glove by simply sliding the bracket over the club and onto the lower portion of the shaft where it is thinner. Then pull the bracket up until it mates securely with the upper bracket. The shape of the brackets where they mate with help the user see if the gloves are aligned correctly. Now the user is ready to swing. The user simply goes through the typical motions, only now golf hands is holding the club. It's easy. They say people stop playing because they get old, the truth is people get old because they stop playing. Stay in the game with golf hands. This design grip can also be applicable for fishing, tennis, skiing, baseball, softball, fencing, or even to attach to any tool used around the house.

In the preferred embodiment, the strap is configured to reduce interference with the hand of a user. The strap has a low profile, smooth surface.

Figure 1:
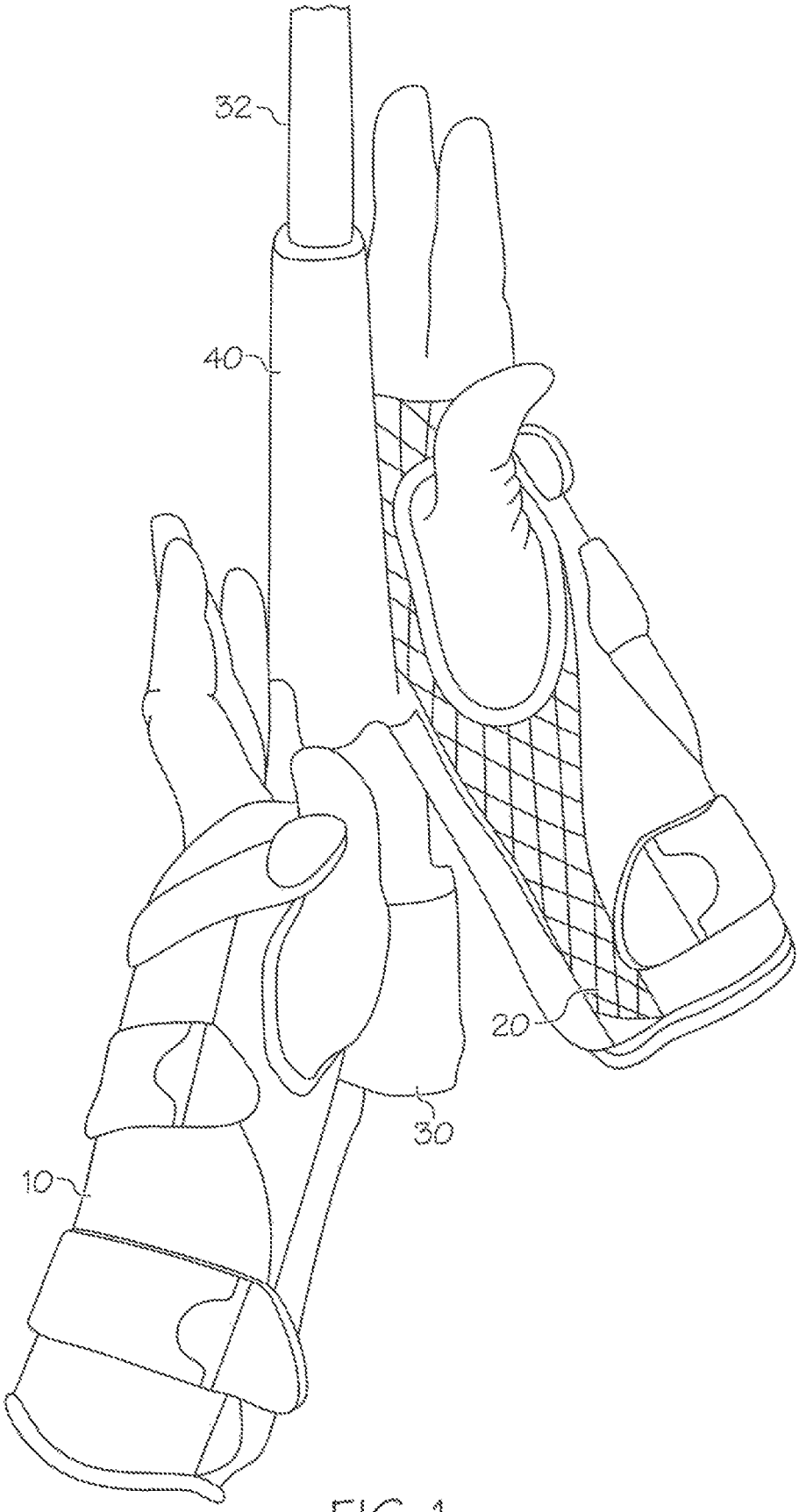
FIG. 1 shows a user's hands inserted in the gloves wherein the gloves are attached to the shaft. The hands are not gripping the shaft.

FIG. 1 shows how golf hands are a pair of gloves that are designed mechanically to attach to your golf club, holding the club so the user does not have to while putting the user's hands in the right position for the proper swing. Golf hands actually becomes the user's hands. The clasp system allows the user to connect and disconnect from any golf club. Once the user locked into place with the club, the user can completely let go and still perform a full and perfect swing without having to worry about the club leaving the user's hands. In order to use golf hands, first the user must put on both gloves and make sure they are on securely. Then the user will attach the upper bracket by opening the lever to loosen the cinch strap, slipping it over the top of the handle. The user then closes the lever to tighten it down. Make sure you have the angle of the club head set where you want it and then lock the club in place. Next the user will use the other glove by simply sliding the bracket over the club and onto the lower portion of the shaft where it is thinner. Then pull the bracket up until it mates securely with the upper bracket. The shape of the brackets where they mate with help the user see if it is aligned correctly. Now the user is ready to swing. Simply go through the normal motions of a swing. Only now golf hands are holding the club for the user. It is easy. As shown, a user can actually let go of the club and hit the ball. The user merely has to rotate their arms without gripping the club. Golf hands does the rest without the user gripping the club. In this embodiment, the means to secure is a C-shaped clamp or strap.

Figure 2:
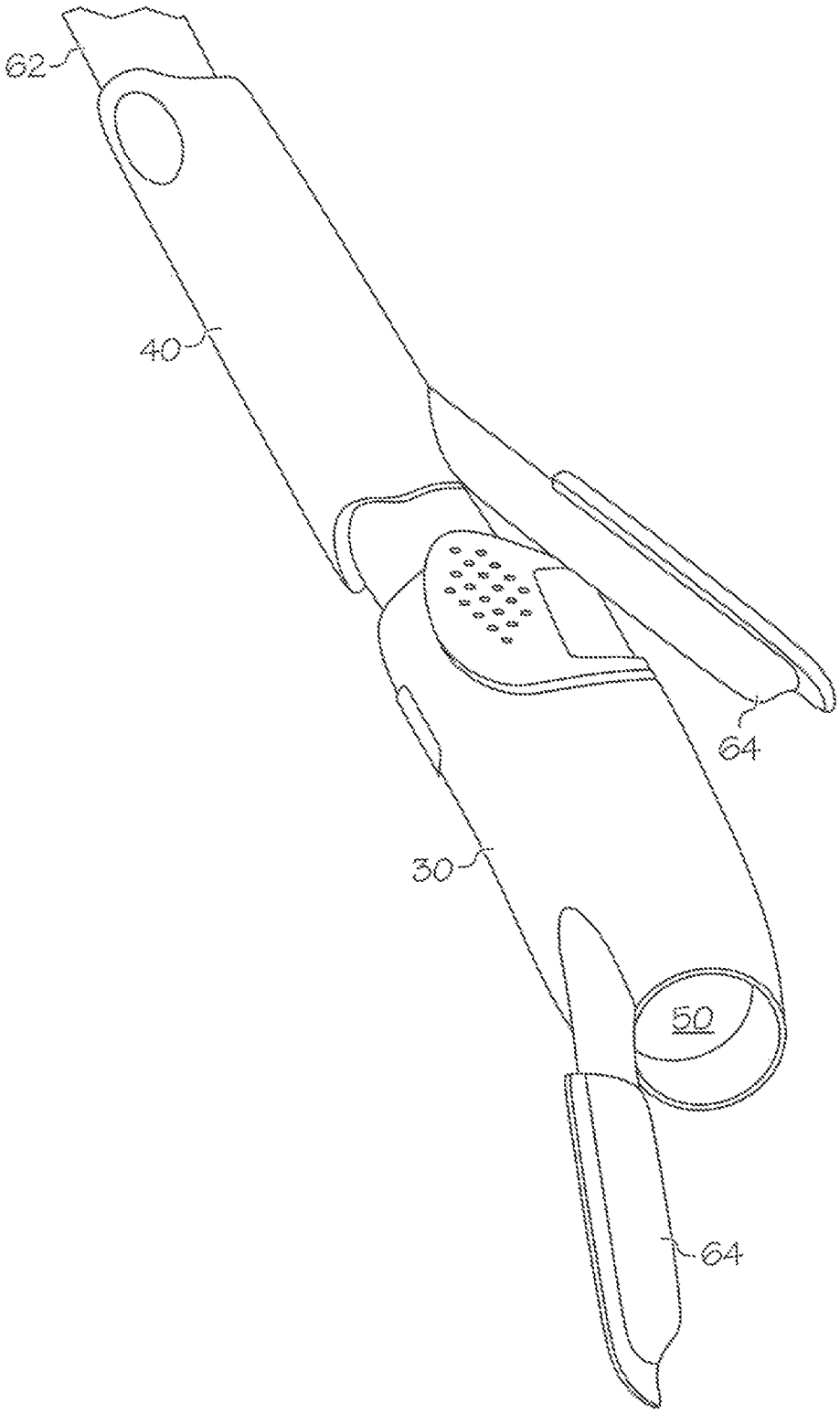
FIG. 2 shows an upper bracket wherein the bracket slides over the top of the grip. The end of the upper bracket is open.

FIG. 2 shows upper an upper bracket wherein the bracket slides over the top of the grip. The end of the upper bracket is open. FIG. 2 shows upper bracket 30 without a glove. Strap 60 secures upper bracket 30 to golf grip 62. Posts 64 are used when a golf glove is not used with upper bracket 30.

Figure 3:
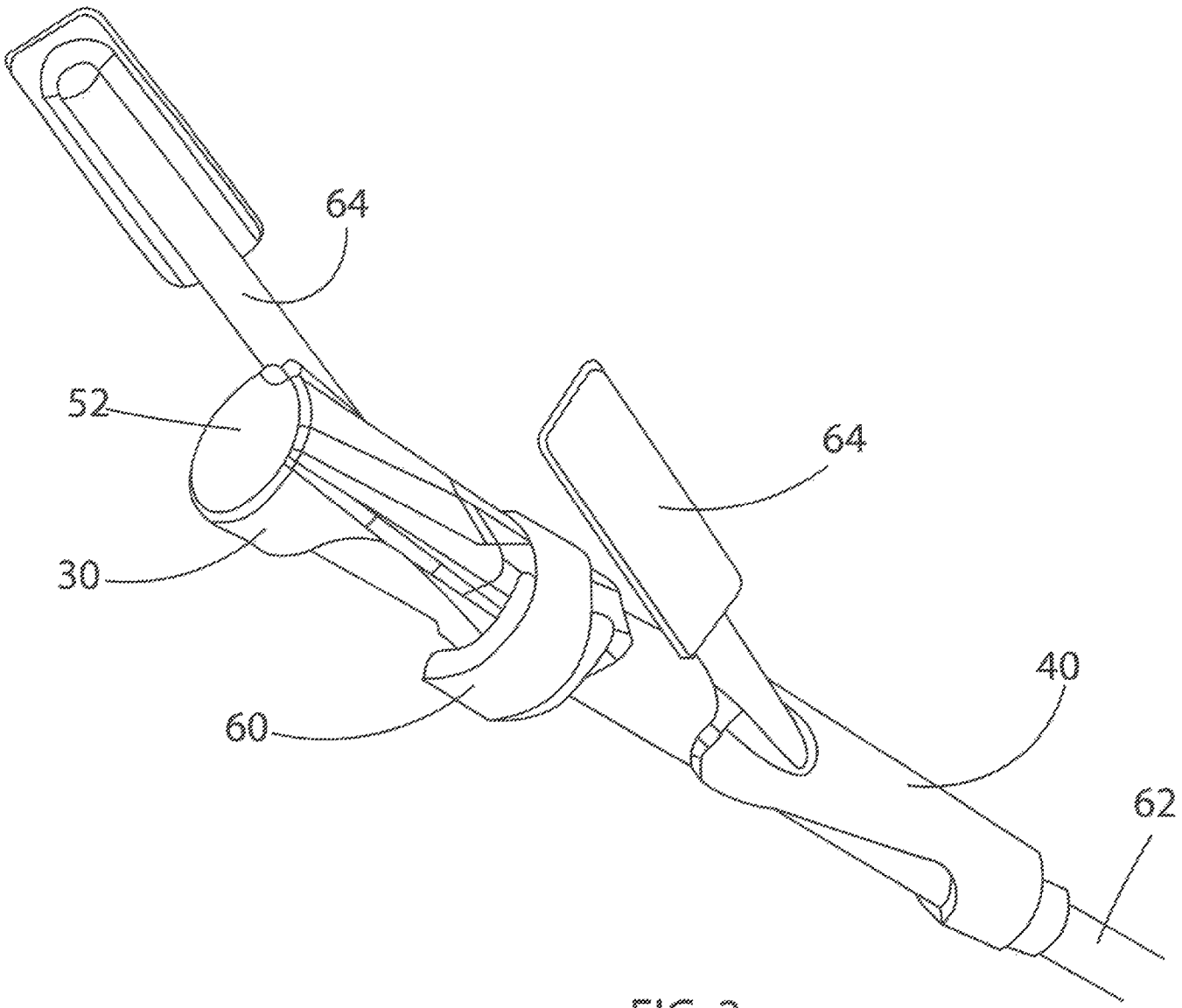
FIG. 3 shows an upper bracket wherein the bracket slides over the top of the grip. The end of the upper bracket is closed.

FIG. 3 shows an upper bracket wherein the bracket slides over the top of the grip. The end of the upper bracket is closed. FIG. 3 shows upper bracket 30 with closed end 52. FIG. 3 also shows the C shaped cross section of lower bracket 40. Strap 60 us a cam-style strap.

Figure 4:
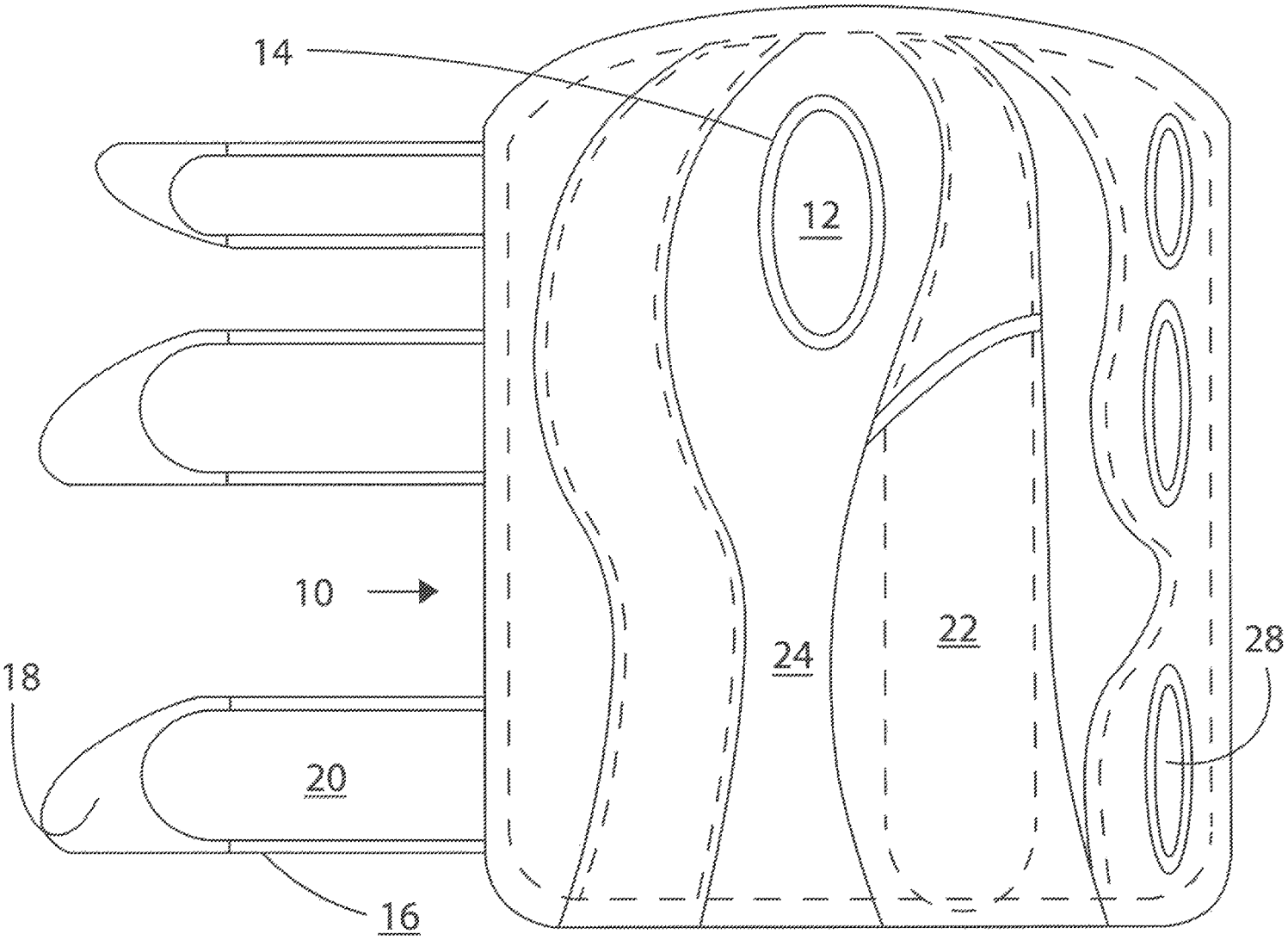
FIG. 4 shows the left-hand glove for a right-handed golfer.

FIG. 4 shoes glove 10. Glove 10 includes thumb opening 12. Neon yellow piping 14 protects thumb opening 12. Straps 16 also are included. Straps 16 further comprises leather tips 18 and Velcro hook strips 20. Velcro loop strips 22 are attached to the body 24 of glove 10. Body 24 also includes mesh material 26. Body 24 typically is made of leather. Glove 10 also includes plastic molded eyelets 28. Glove 10 in FIG. 1 is a left-handed glove.

Figure 5:
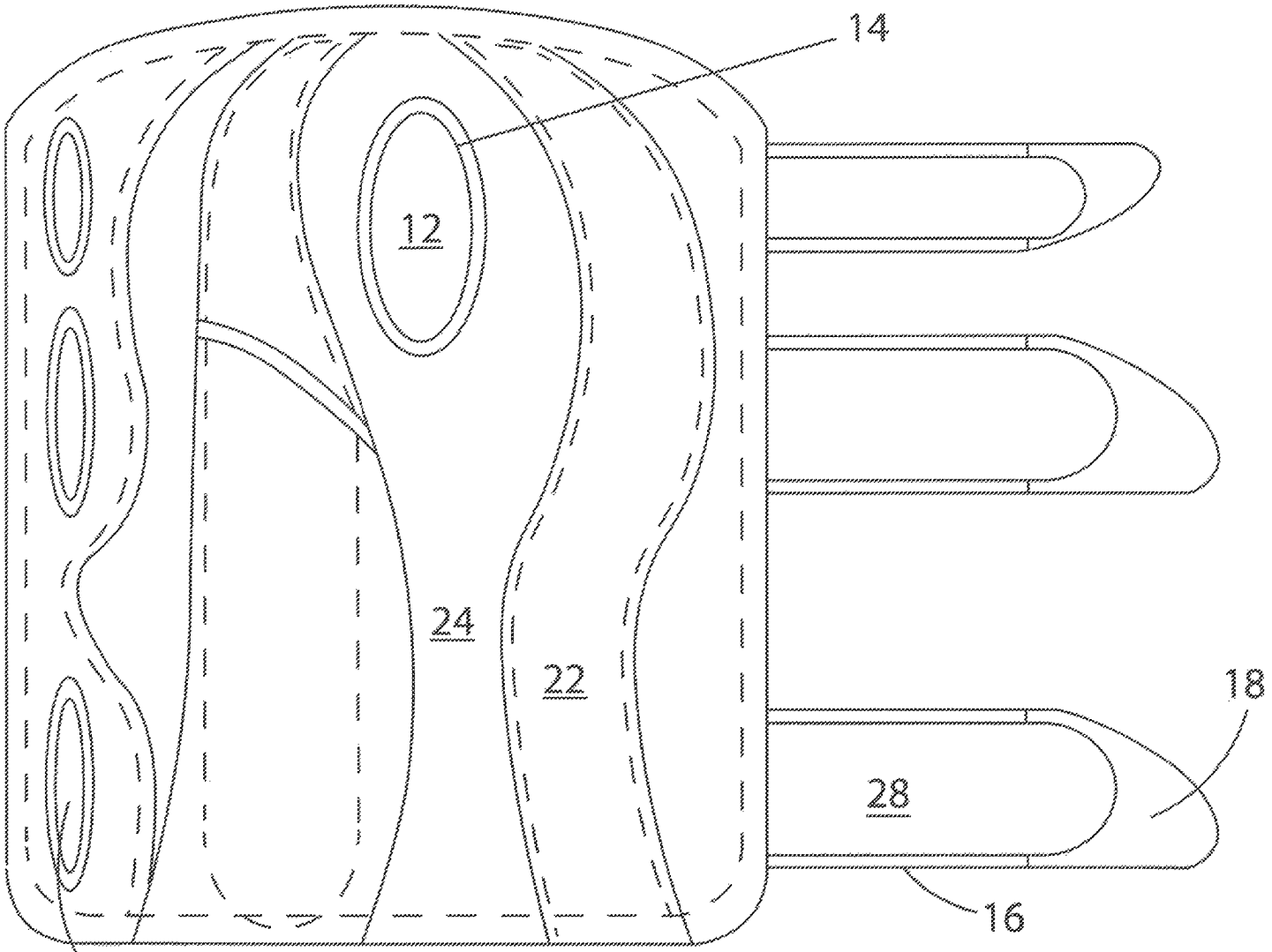
FIG. 5 shows the right-hand for a right-handed golfer.

FIG. 5 shows glove 20. Glove 20 is constructed the same as glove 10 except that glove 20 is a right-handed glove.

Figure 6:
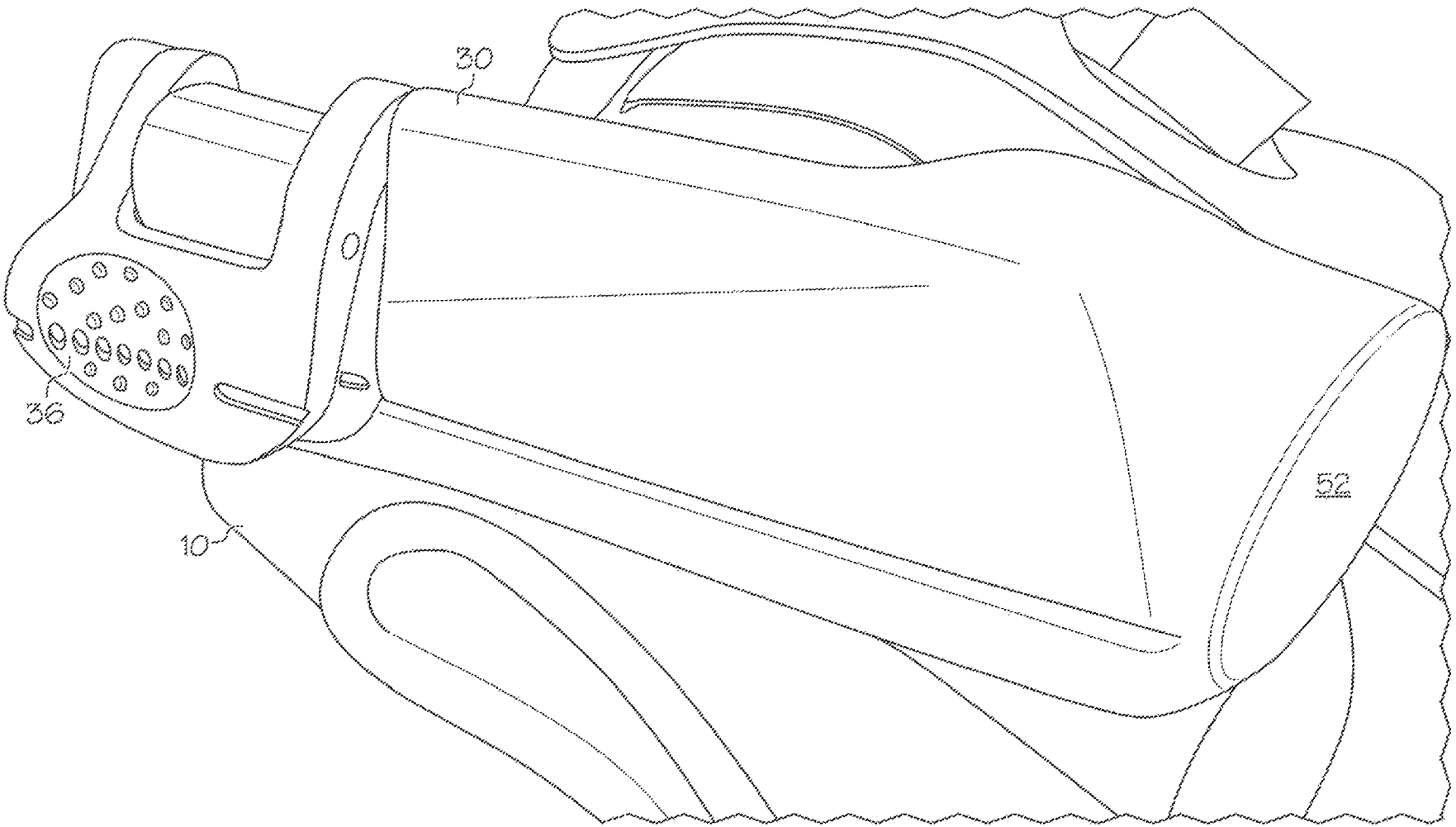
FIG. 6 shows an upper bracket attached to a glove wherein the upper bracket slides over the top of a grip.

FIG. 6 shows upper bracket 30. Bracket 30 is attached to glove 10. Bracket 30 also slides over grip 32 of golf club 34. Upper bracket 30 is attached to grip 32 with cinch strap 36. Upper bracket 30 may have an open or closed end 52 capping grip the end of grip 32.

Figure 7:
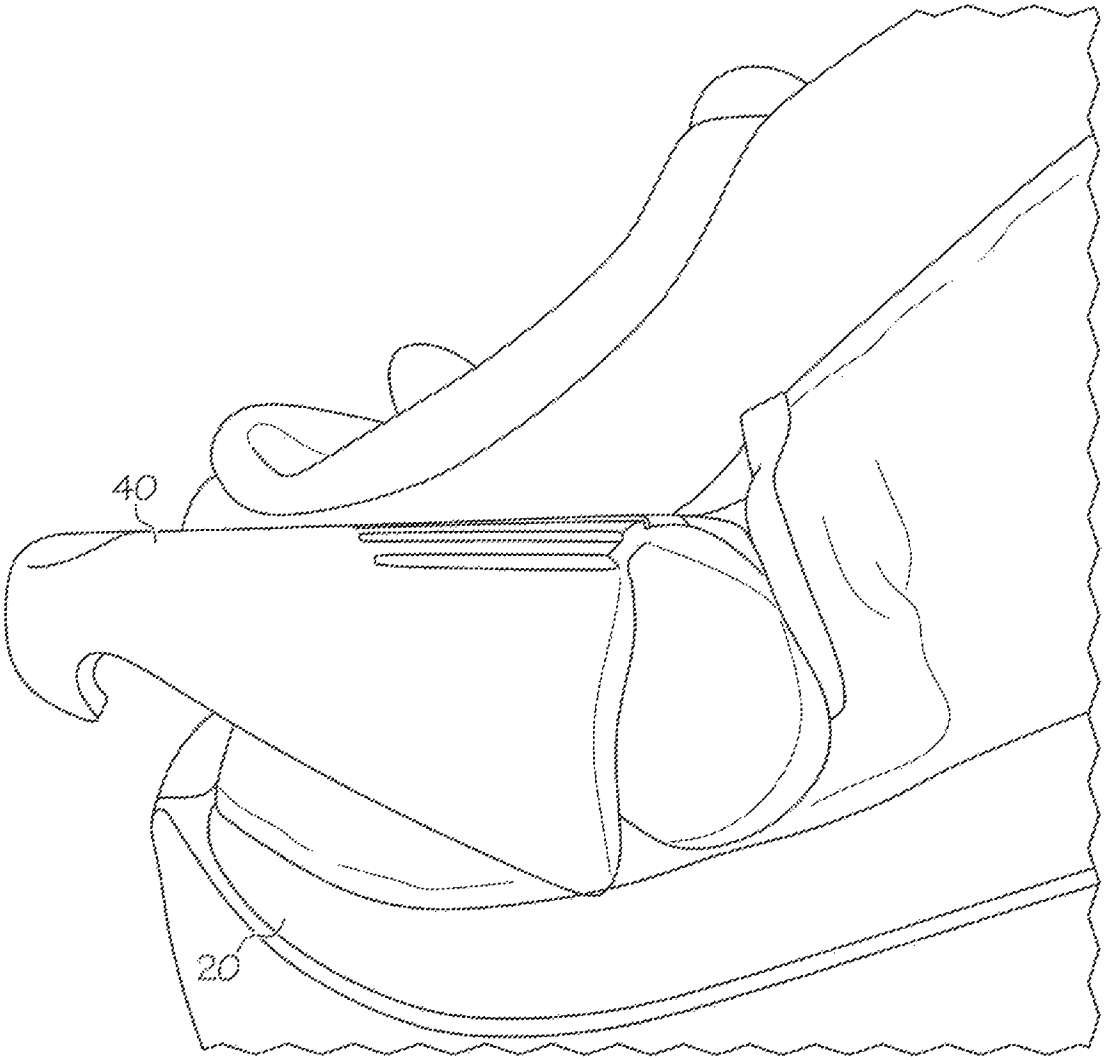
FIG. 7 shows a lower bracket attached to a glove wherein the lower bracket slides over the club onto the lower portion of the grip.

FIG. 7 shows lower bracket 40. Bracket 40 is attached to a glove. Lower bracket 40 has a "C" shaped cross section. Bracket 40 slides over grip 32. Bracket 40 slides up grip 32 until it mates securely with upper bracket 30. The shapes of bracket 30 and bracket 40 align and securely mate with each other.

Upper bracket 30 and lower bracket 40 may be secured to gloves 10 and 20 in a variety of ways. Brackets 30 and 40 may be glued to the gloves 10 and 20. The brackets may be sewn onto the gloves or the brackets may be fastened to the gloves with straps.

Preferably, the sporting device is a golf club. In one embodiment the post has an elongated curved section configured to engage a user's arm.

The golfer will be gripping the club with the "C" part of the attachment and not the post coming out of the back. Both posts cross the wrist. In a preferred embodiment, the posts will be encased in a glove-type of arrangement. There will be a cam type of strap added to the left hand (dominate lead arm for a right-handed golfer). Only that end of the two clasps will be closed off where it slips onto the golf club from the top. The left-hand slides over the grip end of the club, and the club end will slide up into a "cup" on that left hand only. This will allow for both adjustability before the golfer is set, and, more stability once the cam-style strap locks the club into place.

The device of this invention is a go-between for someone who cannot either grip a club, racket, etc. or has no appendage at all to hold said sport implement. The invention gives the user the freedom to swing their implement with nearly a full range of motion and ultimately allows them to continue to participate in their sport. The invention is made of dense plastic materials that support swivel, clamping and anchoring components that allow an individual to use the invention as an extension of their own body, which will allow the ability to move through their sports movement needs as well as handle the abuse of the sport. The invention is also made from dense, but breathable and cleanable fabric the further becomes the support for the swivel, clamp, and anchor components to function properly.

The above-described embodiments are illustrative of only a few of the many possible specific embodiments which can represent applications of the principals of the invention. Numerous and varied other arrangements can be readily devised in accordance with these principles by those skilled in the art without departing from the spirit and scope of the invention.

I claim:

1. A device for assisting a person having insufficient control of one or more hands to strengthen and improve coordination using a sporting element for effectively striking a ball, the device comprising:

a pair of gloves designed mechanically attach to a grip or shaft of the sporting element;

a upper bracket having an elongated open-end, and a tube funnel having a hollow interior portion adapted to be secured to the shaft of the sporting element;

wherein the hollow interior portion of the upper bracket houses an upper portion of the grip or shaft of the sporting element;

a fastener for attaching the upper bracket to one of the gloves of the pair of gloves;

a lower bracket having two spaced apart opposing side walls; wherein the lower bracket is C-shaped; adapted to be secured to a lower portion of the grip or shaft of the sporting element;

a fastener for attaching the lower bracket to a second glove of the pair of gloves; and wherein the upper bracket and lower bracket each have a shape that mate with each other to align the brackets correctly; and an elongated post extending from the upper bracket to aid holding, the grip, or the shaft of the sporting element.

2. A device according to claim 1 wherein the tube funnel has a closed or open-end housing a distal end of the grip or shaft of the sporting element.

3. A device according to claim 1 wherein the C-shaped lower bracket houses a lower section of the grip or shaft of the sporting element.

4. A device according to claim 1 further comprising a fastener to secure the upper bracket and glove to the sporting element.

5. A device according to claim 4 wherein the fastener is a cinch strap.

6. A device according to claim 4 wherein the fastener is a C-shaped clamp or strap.

7. A device according to claim 6 wherein the strap is configured to reduce interference with the hand of a user.

8. A device according to claim 6 wherein the strap has a low profile, smooth surface.

9. A device according to claim 1 wherein the sporting element is a golf club.

10. A device according to claim 1 wherein the elongated posts have an elongated curved section configured to engage a user's arm.

11. A device according to claim 1 wherein the user's hands are free of gripping the grip or shaft.

12. A device for assisting a person having insufficient control of one or more hands to strengthen and improve coordination using a sporting element for effectively striking a ball, the device comprising:

a pair of gloves designed to mechanically attach to a grip or shaft of the sporting element;

an upper bracket having an elongated open-end and a tube funnel having a hollow interior portion adapted to be secured to the shaft of the sporting element;

wherein the hollow interior portion of the upper bracket houses an upper portion of the grip or shaft of the sporting element;

a fastener for attaching the upper bracket to one of the gloves of the pair of gloves;

a lower bracket having two spaced apart opposing side walls; wherein the lower bracket is C-shaped; adapted to be secured to a lower portion of the grip or shaft of the sporting element;

a fastener for attaching the lower bracket to a second glove of the pair of gloves;

wherein the upper bracket and lower bracket each have a shape that mate with each other to align the brackets correctly, and elongated post extending from the lower bracket to aid holding, the grip, or the shaft of the sporting element.

13. A device according to claim 12 wherein the C-shaped body is located between two V-shaped elongated posts.

14. A device according to claim 13 wherein the two V-shaped posts are configured to cross a wrist of a person gripping the C-shaped body portion.

15. A device according to claim 12 further comprising a cam type of strap added to a dominant lead arm gripping the C-shaped body portion.

16. A device according to claim 15 wherein the cam-style strap locks the grip in place.

* * * * *